US010186123B2

(12) United States Patent
Kanaujia et al.

(10) Patent No.: US 10,186,123 B2
(45) Date of Patent: Jan. 22, 2019

(54) COMPLEX EVENT RECOGNITION IN A SENSOR NETWORK

(71) Applicant: Avigilon Fortress Corporation, Vancouver (CA)

(72) Inventors: Atul Kanaujia, South San Francisco, CA (US); Tae Eun Choe, Reston, VA (US); Hongli Deng, Ashburn, VA (US)

(73) Assignee: Avigilon Fortress Corporation, Vancouver (CA)

( * ) Notice: Subject to any disclaimer, the term of this patent is extended or adjusted under 35 U.S.C. 154(b) by 172 days.

(21) Appl. No.: 14/674,889

(22) Filed: Mar. 31, 2015

(65) Prior Publication Data

US 2015/0279182 A1 Oct. 1, 2015

Related U.S. Application Data

(60) Provisional application No. 61/973,611, filed on Apr. 1, 2014.

(51) Int. Cl.
*G08B 13/196* (2006.01)

(52) U.S. Cl.
CPC . *G08B 13/19608* (2013.01); *G08B 13/19645* (2013.01); *G08B 13/19671* (2013.01)

(58) Field of Classification Search
CPC ..... G08B 13/19608; G08B 13/19645; G08B 13/19671
See application file for complete search history.

(56) References Cited

U.S. PATENT DOCUMENTS 5,909,548 A * 6/1999 Klein ..... G06F 17/30017 340/3.1
7,932,923 B2 * 4/2011 Lipton ..... G06F 17/3079 348/143

(Continued)

OTHER PUBLICATIONS

A. Bar-Hillel et al., "Learning a mahalanobis metric from equivalence constraints", Journal of Machine Learning Research, 6:937-965, Jun. 2005.

(Continued)

*Primary Examiner* — Vincent Rudolph
*Assistant Examiner* — Pinalben Patel
(74) *Attorney, Agent, or Firm* — MH2 Technology Law Group, LLP

(57) ABSTRACT

Systems, methods, and manufactures for a surveillance system are provided. The surveillance system includes sensors having at least one non-overlapping field of view. The surveillance system is operable to track a target in an environment using the sensors. The surveillance system is also operable to extract information from images of the target provided by the sensors. The surveillance system is further operable to determine probabilistic confidences corresponding to the information extracted from images of the target. The confidences include at least one confidence corresponding to at least one primitive event. Additionally, the surveillance system is operable to determine grounded formulae by instantiating predefined rules using the confidences. Further, the surveillance system is operable to infer a complex event corresponding to the target using the grounded formulae. Moreover, the surveillance system is operable to provide an output describing the complex event.

30 Claims, 5 Drawing Sheets

(56) References Cited

U.S. PATENT DOCUMENTS

| | | | | |
|---|---|---|---|---|
| 2003/0058111 | A1* | 3/2003 | Lee | G06K 9/00342 340/573.1 |
| 2004/0161133 | A1* | 8/2004 | Elazar | G01S 3/7864 382/115 |
| 2005/0265582 | A1* | 12/2005 | Buehler | G06K 9/00335 382/103 |
| 2006/0279630 | A1* | 12/2006 | Aggarwal | G01S 3/7864 348/143 |
| 2007/0182818 | A1* | 8/2007 | Buehler | G08B 13/19602 348/143 |
| 2007/0291117 | A1* | 12/2007 | Velipasalar | G08B 13/19615 348/152 |
| 2008/0204569 | A1* | 8/2008 | Miller | G06F 17/3079 348/222.1 |
| 2009/0016599 | A1* | 1/2009 | Eaton | G06K 9/00335 382/159 |
| 2009/0153661 | A1* | 6/2009 | Cheng | G06K 9/00771 348/143 |
| 2010/0321183 | A1* | 12/2010 | Donovan | G08B 13/19645 340/540 |

OTHER PUBLICATIONS

A. F. Bobick et al., "Action recognition using probabilistic parsing", CVPR, pp. 196-202, 1998.
M. Brand et al., "Coupled hidden markov models for complex action recognition", CVPR, pp. 1-6, Nov. 1997.
T. E. Choe et al., "Globally optimal target tracking in real time using max-flow network", ICCV Workshops, pp. 1855-1862, Jan. 2011.
P. Domingos et al., "Markov Logic: an Interface Layer for Artificial Intelligence", Synthesis Lectures on Artificial Intelligence and Machine Learning, pp. 1-155, 2009.
P. Domingos et al., "Markov logic: A unifying framework for statistical relation learning", Intro. To Statistical Relational Learning, MIT Press, pp. 1-6, 2007.
P. F. Felzenszwalb et al., "Efficient graph-based image segmentation", International Journal of Computer Vision, 59(2):167-181, 2004.
P. F. Felzenszwalb et al., "A discriminatively trained, multiscale, deformable part model", CVPR, pp. 1-8, 2008.
D. Gray et al., "Evaluating appearance models for recognition, reacquisition, and tracking", IEEE PETS Workshop, pp. 1-7, 2007.
A. Gupta et al., "Understanding videos, constructing plots learning a visually grounded storyline model from annotated videos", CVPR, pp. 2012-2019, 2009.
D. Hoiem et al., "Recovering surface layout from an image", International Journal of Computer Vision, 75(1):151-172, 2007.
S. S. Intille et al., "Visual recognition of multi-agent action using binary temporal relations", CVPR, pp. 1056-1063, 1999.
A. Kembhavi et al., "Why did the person cross the road (there)? Scene understanding using probabilistic logic models and common sense reasoning", ECCV, pp. 693-776, 2010.
Y. L. Li Zhang et al., "Global Data Association for Multi-Object Tracking Using Network Flows", CVPR, pp. 1-8, 2008.
V. I. Morariu et al., "Multi-agent event recognition in structured scenarios", CVPR, pp. 3289-3296, 2011.
J. Muncaster et al., "Activity recognition using dynamic Bayesian networks with automatic state selection", WACV, 59(2)39-47, 2007.
R. Nevatia et al., "Hierarchical language-based representation of events in video stream", IEEE. Proc. of CVPRW on Event Mining, 59(2)39-47, 2003.
F. Niu et al., "Scaling up statistical inference in markov logic networks using an rdbms", VLDB, pp. 994-999, 2011.
S. Oh et al., "A large-scale benchmark dataset for event recognition in surveillance video", pp. 1-8, CVPR, 2011.
N. Rota et al., "Activity recognition from video sequences using declarative models", ECAI, pp. 1-5, 2000.
M. S. Ryoo et al., "Recognition of composite human activities through context-free grammar based representation", CVPR (2), pp. 1709-1718, 2006.
A. Sadilek et al., "Recognizing multi-agent activities from gps data", AAAI, pp. 1-6, 2010.
P. Singla et al., "Discriminative training of markov logic networks", AAAI, pp. 868-873, 2005.
M. Sridhar et al., "Unsupervised learning of event classes from video", AAAI, pp. 180-186, 2010.
S. D. Tran et al., "Event modeling and recognition using markov logic networks", ECCW, pp. 610-623, 2008.
Z. Tu et al., "Image parsing: Unifying segmentation, detection, and recognition", Toward Category-Level Object Recognition, pp. 545-576, 2006.
O. Tuzel et al., "Region covariance: A fast descriptor for detection and classification", ECCV, pp. 589-600, 2006.
J. Yamato et al., "Recognizing human action time-sequential images using hidden markov model", CVPR, pp. 673-680, 1992.
R. Zhao et al., "Unsupervised salience learning for person re-identification", CVPR, pp. 3586-3593, 2013.
ILIDS, "Imagery library for intelligent detection systems", Center for the Protection of National Infrastructure, Feb. 2011, pp. 1-64.
Yifan Shi et al., "Learning temporal sequence model from partially labeled data", CVPR '06, 2006, pp. 1-9.
V. Leung et al., "Flexible Tracklet Association for Complex Scenarios using a Markov Logic Network", ICVV Workshops, 2011, pp. 1870-1875.

* cited by examiner

COMPLEX EVENT RECOGNITION IN A SENSOR NETWORK

RELATED APPLICATIONS

This application claims benefit of prior provisional Application No. 61/973,611, filed Apr. 1, 2014, the entire disclosure of which is incorporated herein by reference.

GOVERNMENT RIGHTS

This invention was made with government support under Contract No. N00014-12-C-0263 awarded by Office of Naval Research. The government has certain rights in the invention.

FIELD

This disclosure relates to surveillance systems. More specifically, the disclosure relates to a video-based surveillance system that fuses information from multiple surveillance sensors.

BACKGROUND

Video surveillance is critical in many circumstances. One problem with video surveillance is that videos are manually intensive to monitor. Video monitoring can be automated using intelligent video surveillance systems. Based on user defined rules or policies, intelligent video surveillance systems can automatically identify potential threats by detecting, tracking, and analyzing targets in a scene. However, these systems do not remember past targets, especially when the targets appear to act normally. Thus, such systems cannot detect threats that can only be inferred. For example, a facility may use multiple surveillance cameras to that automatically provide an alert after identifying a suspicious target. The alert may be issued when the cameras identify some target (e.g., a human, bicycle, or vehicle) loitering around the building for more than fifteen minutes. However, such system may not issue an alert when a target approaches the site several times in a day.

SUMMARY

The present disclosure provides systems and methods for a surveillance system. The surveillance system includes multiple_sensors. The surveillance system is operable to track a target in an environment using the sensors. The surveillance system is also operable to extract information from images of the target provided by the sensors. The surveillance system is further operable to determine confidences corresponding to the information extracted from images of the target. The confidences include at least one confidence corresponding to at least one primitive event. Additionally, the surveillance system is operable to determine grounded formulae by instantiating predefined rules using the confidences. Further, the surveillance system is operable to infer a complex event corresponding to the target using the grounded formulae. Moreover, the surveillance system is operable to provide an output describing the complex event.

BRIEF DESCRIPTION OF THE DRAWINGS

The accompanying drawings, which are incorporated in and constitute a part of this specification, illustrate the present teachings and together with the description, serve to explain the principles of the disclosure.

Figure 1:
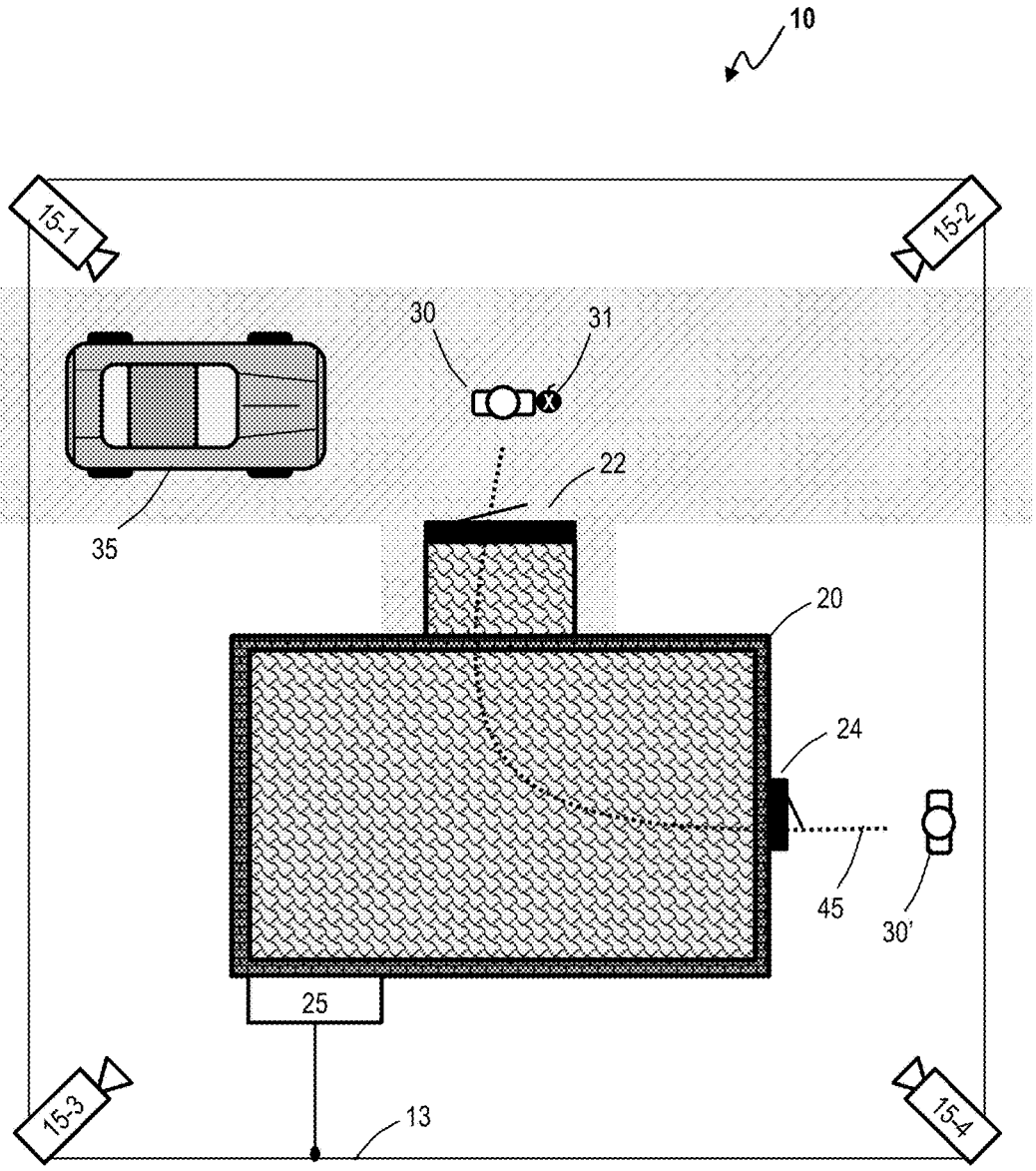
FIG. 1 illustrates a block diagram of an environment for implementing systems and processes in accordance with aspects of the present disclosure.

It should be noted that some details of the figures have been simplified and are drawn to facilitate understanding of the present teachings, rather than to maintain strict structural accuracy, detail, and scale.

DETAILED DESCRIPTION

This disclosure relates to surveillance systems. More specifically, the disclosure relates to a video-based surveillance systems that fuse information from multiple surveillance sensors. Surveillance systems in accordance with aspects of the present disclosure automatically extract information from a network of sensors and make human-like inferences. Such high-level cognitive reasoning entails determining complex events (e.g., a person entering a building using one door and exiting from a different door) by fusing information in the form of symbolic observations, domain knowledge of various real-world entities and their attributes, and interactions between them.

In accordance with aspects of the invention, a complex event is determined to have likely occurred based only on other observed events and not based on a direct observation of the complex event itself. In embodiments, a complex event can be an event determined to have occurred based only on circumstantial evidence. For example, if a person enters a building with a package and exits the building without the package (e.g., a bag), it may be inferred that the person left the package is in the building.

Complex events are difficult to determine due to the variety of ways in which different parts of such events can be observed. A surveillance system in accordance with the present disclosure infers events in real-world conditions and, therefore, requires efficient representation of the interplay between the constituent entities and events, while taking into account uncertainty and ambiguity of the observations. Further, decision making for such a surveillance system is a complex task because such decisions involve analyzing information having different levels of abstraction from disparate sources and with different levels of certainty (e.g., probabilistic confidence), merging the information by weighing in on some data source more than other, and arriving at a conclusion by exploring all possible alternatives. Further, uncertainty must be dealt with due to a lack of effective visual processing tools, incomplete domain knowledge, lack of uniformity and constancy in the data, and faulty sensors. For example, target appearance frequently changes over time and across different sensors, data representations may not be compatible due to difference in the characteristics, levels of granularity and semantics encoded in data.

Surveillance systems in accordance with aspects of the present disclosure include a Markov logic-based decision system that recognizes complex events in videos acquired from a network of sensors. In embodiments, the sensors can have overlapping and/or non-overlapping fields of view. Additionally, in embodiments, the sensors can be calibrated or non-calibrated Markov logic networks provide mathematically sound and robust techniques for representing and fusing the data at multiple levels of abstraction, and across multiple modalities to perform complex task of decision making. By employing Markov logic networks, embodiments of the disclosed surveillance system can merge information about entities tracked by the sensors (e.g., humans, vehicles, bags, and scene elements) using a multi-level inference process to identify complex events. Further, the Markov logic networks provide a framework for overcoming any semantic gaps between the low-level visual processing of raw data obtained from disparate sensors and the desired high-level symbolic information for making decisions based on the complex events occurring in a scene.

Markov logic networks in accordance with aspects of the present disclosure use probabilistic first order predicate logic (FOPL) formulas representing the decomposition of real world events into visual concepts, interactions among the real-world entities, and contextual relations between visual entities and the scene elements. Notably, while the first order predicate logic formulas may be true in the real world, they are not always true. In surveillance environments, it is very difficult to come up with non-trivial formulas that are always true, and such formulas capture only a fraction of the relevant knowledge. For example, while the rule that "pigs do not fly" may always be true, such a rule has little relevance to surveilling and office building and, even if it were relevant, would not encompass all of the other events that might be encountered around a office building. Thus, despite its expressiveness, such pure first order predicate logic has limited applicability to practical problems of drawing inferences. Therefore, in accordance with aspects of the present disclosure, the Markov logic network defines complex events and object assertions by hard rules that are always true and soft rules that are usually true. The combination of hard rules and soft rules encompasses all events relevant to a particular set of threat for which a surveillance system monitors in particular environment. For example, the hard rules and soft rules disclosed herein can encompass all events related to monitoring for suspicious packages being left by individuals at an office building.

In accordance with aspects of the present disclosure, the uncertainty as to the rules is represented by associating each first order predicate logic (FOPL) formulas with a weight reflecting its uncertainty (e.g., a probabilistic confidence representing how strong a constraint is). That is, the higher the weight, the greater the difference in probability between truth states of occurrence of an event or observation of an object that satisfies the formula and one that does not, provided that other variables stay equal. In general, a rule for detecting a complex action entails all of its parts, and each part provides (soft) evidence for the actual occurrence of the complex action. Therefore, in accordance with aspects of the present disclosure, even if some parts of a complex action are not seen, it is still possible to detect the complex event across multiple sensors using the Markov logic network inference.

Markov logic networks allow for flexible rule definitions with existential quantifiers over sets of entities, and therefore allow expressive power of the domain knowledge. The Markov logic networks in accordance with aspects of the present disclosure models uncertainty at multiple levels of inference, and propagates the uncertainty bottom-up for more accurate and/or effective high-level decision making with regard to complex events. Additionally, surveillance systems in accordance with the present disclosure scale the Markov logic networks to infer more complex activities involving network of visual sensors under increased uncertainty due to inaccurate target associations across sensors. Further, surveillance systems in accordance with the present disclosure apply rule weights learning for fusing information acquired from multiple sensors (target track association) and enhance visual concept extraction techniques using distance metric learning.

Additionally, Markov logic networks allow multiple knowledge bases to be combined into a compact probabilistic model by assigning weights to the formulas, and is supported by a large range of learning and inference algorithms. Not only the weights, but also the rules can be learned from the data set using Inductive logic programming (ILP). As the exact inference is intractable, Gibbs sampling (MCMC process) can be used for performing the approximate inference. The rules form a template for constructing the Markov logic networks from evidence. Evidence are in the form of grounded predicates obtained by instantiating variables using all possible observed confidences. The truth assignment for each of the predicates of the Markov Random Field defines a possible world x. The probability distribution over the possible worlds W, defined as joint distribution over the nodes of the corresponding Markov Random Field network, is the product of potentials associated with the cliques of the Markov Network:

$$P(W = x) = \frac{1}{Z}\prod_k \phi_k(x_{\{k\}}) = \frac{1}{Z}\exp\left(\sum_k w_k f_k(x_{\{k\}})\right) \tag{1}$$

where:

$x\{k\}$ denotes the truth assignments of the nodes corresponding to kth clique of the Markov Random Field;

$\phi_k(x_{\{k\}})$ is the potential function associated to the kth clique, wherein a clique in Markov Random Field corresponds to a grounded formula of the Markov logic networks; and $f_k(x)$ is the feature associated to the kth clique, wherein $f_k(x)$ is 1 if the associated grounded formula is true, and 0 other wise, for each possible state of the nodes in the clique.

The weights associated to the kth formula $w_k$ can be assigned manually or learned. This can be reformulated as:

$$P(W = x) = \frac{1}{Z}\exp\left(\sum_k w_k f_k(x)\right) = \frac{1}{Z}\exp\left(\sum_k w_k n_k(x)\right) \tag{2}$$

where:

$n_k(x)$ is the number of the times kth formula is true for different possible states of the nodes corresponding the kth clique $x_{\{j\}}$.

Z refers to the partition function and is not used in the inference process, that involves maximizing the log-likelihood function.

Equations (1) and (2) represent that if the $k^{th}$ rule with weight $w_k$ is satisfied for a given set of confidences and grounded atoms, the corresponding world is $\exp(w_k)$ times more probable than when the $k^{th}$ rule is not satisfied.

For detecting occurrence of an activity, embodiments disclosed herein query the Markov logic network using the corresponding predicate. Given a set of evidence predicates x=e, hidden predicates u and query predicates y, inference involves evaluating the MAP (Maximum-A-Posterior) distribution over query predicates y conditioned on the evidence predicates x and marginalizing out the hidden nodes u as P(y|x):

$$\arg\max_y \frac{1}{Z_x} \sum_{u \in \{0,1\}} \exp\left(\sum_k w_k n_k(y, u, x = e)\right) \tag{3}$$

Markov logic networks support both generatively and discriminatively weigh learning. Generative learning involves maximizing the log of the likelihood function to estimate the weights of the rules. The gradient computation uses partition function Z. Even for reasonably sized domains, optimizing log-likelihood is intractable as it involves counting number of groundings $n_i(x)$ in which $i^{th}$ formula is true. Therefore, instead of optimizing likelihood, generative learning in existing implementation uses pseudo-log likelihood (PLL). The difference between PLL and log-likelihood is that, instead of using chain rule to factorize the joint distribution over entire nodes, embodiments disclosed herein use Markov blanket to factorize the joint distribution into conditionals. The advantage of doing this is that predicates that do not appear in the same formula as a node can be ignored. Thus, embodiments disclosed herein scale inference to support multiple activities and longer videos, which can greatly increase the speed inference. Discriminative learning on the other hand maximizes the conditional log-likelihood (CLL) of the queried atom given the observed atoms. The set of queried atoms need to be specified for discriminative learning. All the atoms are partitioned into observed X and queried Y. CLL is easier to optimize compared to the combined log-likelihood function of generative learning as the evidence constrains the probability of the query atoms to a much fewer possible states. Note that CLL and PLL optimization are equivalent when evidence predicates include the entire Markov Blanket of the query atoms. A number of gradient-based optimization techniques can be used (e.g., voted perceptron, contrastive divergence, diagonal Newton method and scaled conjugate gradient) for minimizing negative CLL. Learning weights by optimizing the CLL gives more accurate estimates of weights compared to PLL optimization.

FIG. 1 depicts a top view of an example environment 10 in accordance with aspects of the present disclosure. The environment 10 includes a network 13 of surveillance sensors 15-1, 15-2, 15-3, 15-4 (i.e., sensors 15) around a building 20. The sensors 15 can be calibrated or non-calibrated sensors. Additionally, the sensors 15 can have overlapping or non-overlapping fields of view. The building can have two doors 22 and 24, which are entrances/exits of the building 20. A surveillance system 25 can monitor each of the sensors 15. Additionally, the environment 10 can include a target 30, which may be, e.g., a person, and a target 35, which may be, e.g., a vehicle. Further, the target 30 may carry and item, such as a package 31 (e.g., a bag).

In accordance with aspects of the present disclosure the surveillance system 25 visually monitors the spatial and temporal domains of the environment 10 around the building 20. Spatially, the monitoring area from the fields of view of the individual sensors 15 may be expanded to the whole environment 10 by fusing the information gathered by the sensors 15. Temporally, the surveillance system 25 can track the targets 30, 35 for a long periods of time, even the targets 30, 35 they may be temporarily outside of a field of view of one of the sensors 15. For example, if target 30 is in a field of view of sensor 15-2 and enters building 20 via door 22 and exits back into the field of view of sensor 15-2 after several minutes, the surveillance system 25 can recognize that it is the same target that was tracked previously. Thus, the surveillance system 25 disclosed herein can identify events as suspicious when the sensors 15 track the target 30 following a path indicated by the dashed line 45. In this example situation, the target 30 performs the complex behavior of carrying the package 31 when entering door 22 of the building 20 and subsequently reappearing as target 30' without the package when exiting door 24. After identifying the event of target 30 leaving the package 31 in the building 20, the surveillance system 25 can semantically label segments of the video including the suspicious events and/or issue an alert to an operator.

Figure 2:
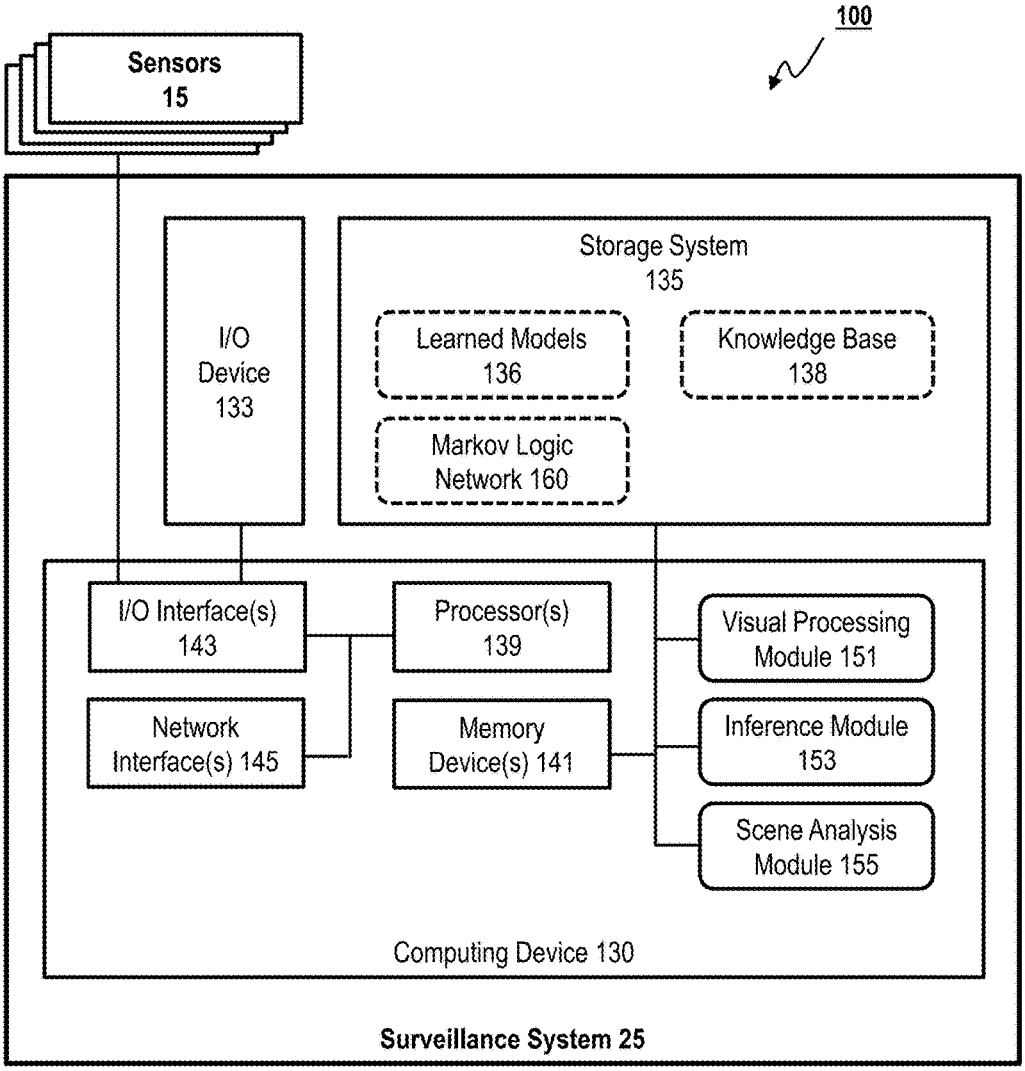
FIG. 2 illustrates a system block diagram of a surveillance system in accordance with aspects of the present disclosure.

FIG. 2 illustrates a system block diagram of a system 100 in accordance with aspects of the present disclosure. The system 100 includes sensors 15 and surveillance system 25, which can be the same or similar to those previously discussed herein. In accordance with aspects of the present disclosure, sensors 15 are any apparatus for obtaining information about events occurring in a view. Examples include: color and monochrome cameras, video cameras, static cameras, pan-tilt-zoom cameras, omni-cameras, closed-circuit television (CCTV) cameras, charge-coupled device (CCD) sensors, analog and digital cameras, PC cameras, web cameras, tripwire event detectors, loitering event detectors, and infra-red-imaging devices. If not more specifically described herein, a "camera" refers to any sensing device.

In accordance with aspects of the present disclosure, the surveillance system 25 includes hardware and software that perform the processes and functions described herein. In particular, the surveillance system 25 includes a computing device 130, an input/output (I/O) device 133, and a storage system 135. The I/O device 133 can include any device that enables an individual to interact with the computing device 130 (e.g., a user interface) and/or any device that enables the computing device 130 to communicate with one or more other computing devices using any type of communications link. The I/O device 133 can be, for example, a handheld device, PDA, smartphone, touchscreen display, handset, keyboard, etc.

The storage system 135 can comprise a computer-readable, non-volatile hardware storage device that stores information and program instructions. For example, the storage system 135 can be one or more flash drives and/or hard disk drives. In accordance with aspects of the present disclosure, the storage device 135 includes a database of learned models 136 and a knowledge base 138. In accordance with aspects of the present disclosure, learned models 136 is a database or other dataset of information including domain knowledge of an environment under surveillance (e.g., environment 10) and objects the may appear in the environment (e.g., buildings, people, vehicles, and packages). In embodiments, learned models 136 associate information of entities and events in the environment with spatial and temporal information. Thus, functional modules (e.g., program and/or application modules), such as those disclosed herein, can use the information stored in the learned models 136 for detecting, tracking, identifying, and classifying objects, entities, and or events in the environment.

In accordance with aspects of the present disclosure, the knowledge base 138 includes hard and soft rules modeling spatial and temporal interactions between various entities and the temporal structure of various complex events. The hard and soft rules can be first order predicate logic (FOPL) formulas of a Markov logic network, such as those previously described herein.

In embodiments, the computing device 130 includes one or more processors 139, one or more memory devices 141 (e.g., RAM and ROM), one or more I/O interfaces 143, and one or more network interfaces 144. The memory device 141 can include a local memory (e.g., a random access memory and a cache memory) employed during execution of program instructions. Additionally, the computing device 130 includes at least one communication channel (e.g., a data bus) by which it communicates with the I/O device 133, the storage system 135, and the device selector 137. The processor 139 executes computer program instructions (e.g., an operating system and/or application programs), which can be stored in the memory device 141 and/or storage system 135.

Moreover, the processor 139 can execute computer program instructions of an visual processing module 151, an inference module 153, and a scene analysis module 155. In accordance with aspects of the present disclosure, the visual processing module 151 processes information obtained from the sensors 15 to detect, track, and classify object in the environment information included in the learned models 136. In embodiments, the visual processing module 151 extracts visual concepts by determining values for confidences that represent space-time (i.e., position and time) locations of the objects in an environment, elements in the environment, entity classes, and primitive events. The inference module 153 fuses information of targets detected in multiple sensors using different entity similarity scores and spatial-temporal constraints, with the fusion parameters (weights) learned discriminatively using a Markov logic network framework from a few labeled exemplars. Further, the inference module 153 uses the confidences determined by the visual processing module 151 to ground (a.k.a., instantiate) variables in rules of the knowledge base 138. The rules with the grounded variables are referred to herein as grounded predicates. Using the grounded predicates, the inference module 153 can construct a Markov logic network 160 and infer complex events by fusing the heterogeneous information (e.g., text description, radar signal) generated using information obtained from the sensors 15. The scene analysis module 155 provides outputs using the Markov logic network 160. For example, using the scene analysis module 155 can execute queries, label portions of the images associated with inferred events, and output tracking result information.

It is noted that the computing device 130 can comprise any general purpose computing article of manufacture capable of executing computer program instructions installed thereon (e.g., a personal computer, server, etc.). However, the computing device 130 is only representative of various possible equivalent-computing devices that can perform the processes described herein. To this extent, in embodiments, the functionality provided by the computing device 130 can be any combination of general and/or specific purpose hardware and/or computer program instructions. In each embodiment, the program instructions and hardware can be created using standard programming and engineering techniques, respectively.

Figure 3:
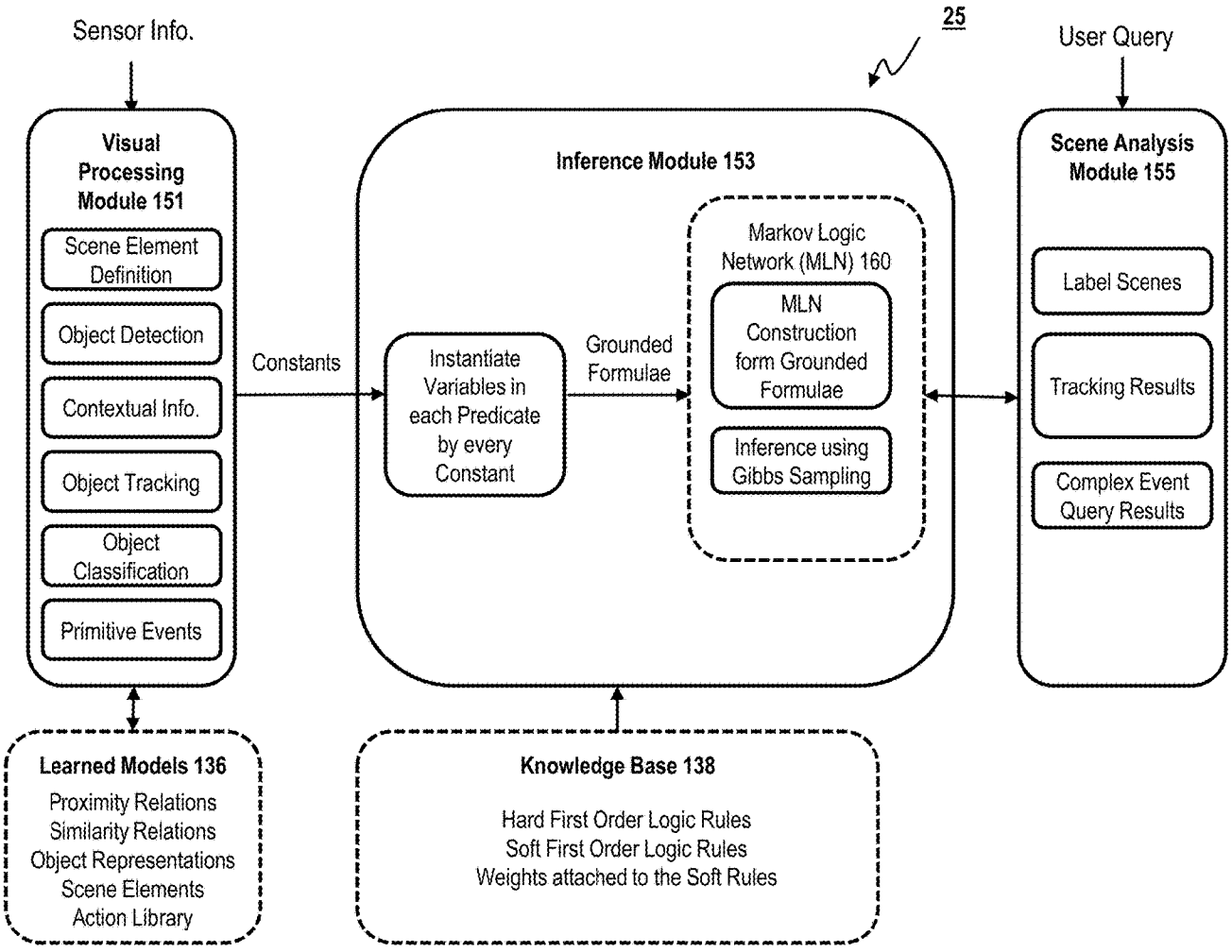
FIG. 3 illustrates a functional block diagram of a surveillance system in accordance with aspects of the present disclosure.

FIG. 3 illustrates a functional flow diagram depicting an example process of the surveillance system 25 in accordance with aspects of the present disclosure. In embodiments, the surveillance system 25 includes learned models 136, knowledge base 138, visual processing module 151, inference module 153, and scene analysis module 155, and Markov logic network 160, which may be the same or similar to those previously discussed herein.

In accordance with aspects of the present disclosure, the visual processing module 151 monitors sensors (e.g., sensors 15) to extract visual concepts and to track targets across the different fields of view of the sensors. The visual processing module 151 processes videos and extracts visual concepts in the form of confidences, which denote times and locations of the entities detected in the scene, scene elements, entity class and primitive events directly inferred from the visual tracks of the entities. The extraction can include and/or reference information in the learned models 136, such as time and space proximity relationships, object appearance representations, scene elements, rules and proofs of actions that targets can perform, etc. For example, the learned modules 138 can identify the horizon line and/or ground plane in the field of view of each of the sensors 15. Thus, based on learned models 136, the visual processing model 151 can identify some objects in the environment as being on the ground, and other objects as being in the sky. Additionally, the learned models 136 can identify objects such as entrance points (e.g., doors 22, 24) of a building (e.g., building 20) in the field of view of each of the sensors 15. Thus, the visual processing mode 151 can identify some objects as appearing or disappearing at an entrance point. Further, learned models 136 can include information used to identify objects (e.g., individuals, cars, packages) and events (moving, stopping, and disappearing) that can occur in the environment. Moreover, learned models 136 can include basic rules that can be used when identifying the objects or events. For example, a rule can be "human tracks are more likely to be on a ground plane," which can assist in the identification of an object as a human, rather than a different object flying above the horizon line. The confidences can be used to ground (e.g., instantiate) the variables in the first-order predicate logic formulae of Markov logic network 160.

In embodiments, the visual processing includes detection, tracking and classification of human and vehicle targets, and attributes extraction (e.g., such as carrying a package 31). Targets can localized in the scene using background subtraction and tracked in 2D image sequence using Kalman filtering. Targets are classified to human/vehicle based on their aspect ratio. Vehicles are further classified into Sedans, SUVs and pick-up trucks using 3D vehicle fitting. The primitive events (a.k.a., atomic events) about target dynamics (moving or stationary) are generated from the target tracks. For each event the visual processing module 151 generates confidences for the time interval and pixel location of the target in 2D image (or the location on the map if homography is available). Furthermore, the visual processing module 151 learns discriminative deformable part-based classifiers to compute a probability scores for whether a human target is carrying a package. The classification score is fused across the track by taking average of top K confident scores (based on absolute values) and is calibrated to a probability score using logistic regression.

In accordance with aspects of the present disclosure, the knowledge base 138 includes hard and soft rules for modeling spatial and temporal interactions between various entities and the temporal structure of various complex events. The hard rules are assertions that should be strictly satisfied for an associated complex event to be identified. Violation of hard rules sets the probability of the complex event to zero. For example, a hard rule can be "cars do not fly," whereas soft rules allow uncertainty and exceptions.

Violation of soft rules will make the complex event less probable but not impossible. For example, a soft rule can be, "walking pedestrians on foot do not exceed a velocity of 10 miles per hour." Thus, the rules can be used to determine that a fast moving object on the ground is a vehicle, rather than a person.

The rules in the knowledge base 138 can be used to construct the Markov logic network 160. For every set of confidences (detected visual entities and atomic events) determined by the visual processing model 151, the first-order predicate logic rules involving the corresponding variables are instantiated to form the Markov logic network 160. As discussed previously, the Markov logic network 160 can be comprised of nodes and edges, wherein the nodes comprise the grounded predicate. An edge exists between two nodes if the predicates appear in a formula. From the Markov logic network 160, MAP inference can be run to infer probabilities of query nodes after conditioning them with observed nodes and marginalizing out the hidden nodes. Targets detected from multiple sensors are associated across multiple sensors using appearance, shape and spatial-temporal cues. The homography is estimated by manually labeling correspondences between the image and a ground map. The coordinated activities include, for example, dropping bag in a building and stealing bag from a building.

Scene Analysis Module

In embodiments, the scene analysis module 155 can automatically determine labels for basic events and complex events in the environment using relationships and probabilities defined by the Markov logic network. For example, the scene analysis module 155 can label segments of video including suspicious events identified using one or more of the complex events and issue to a user an alert including the segments of the video.

Figure 4:
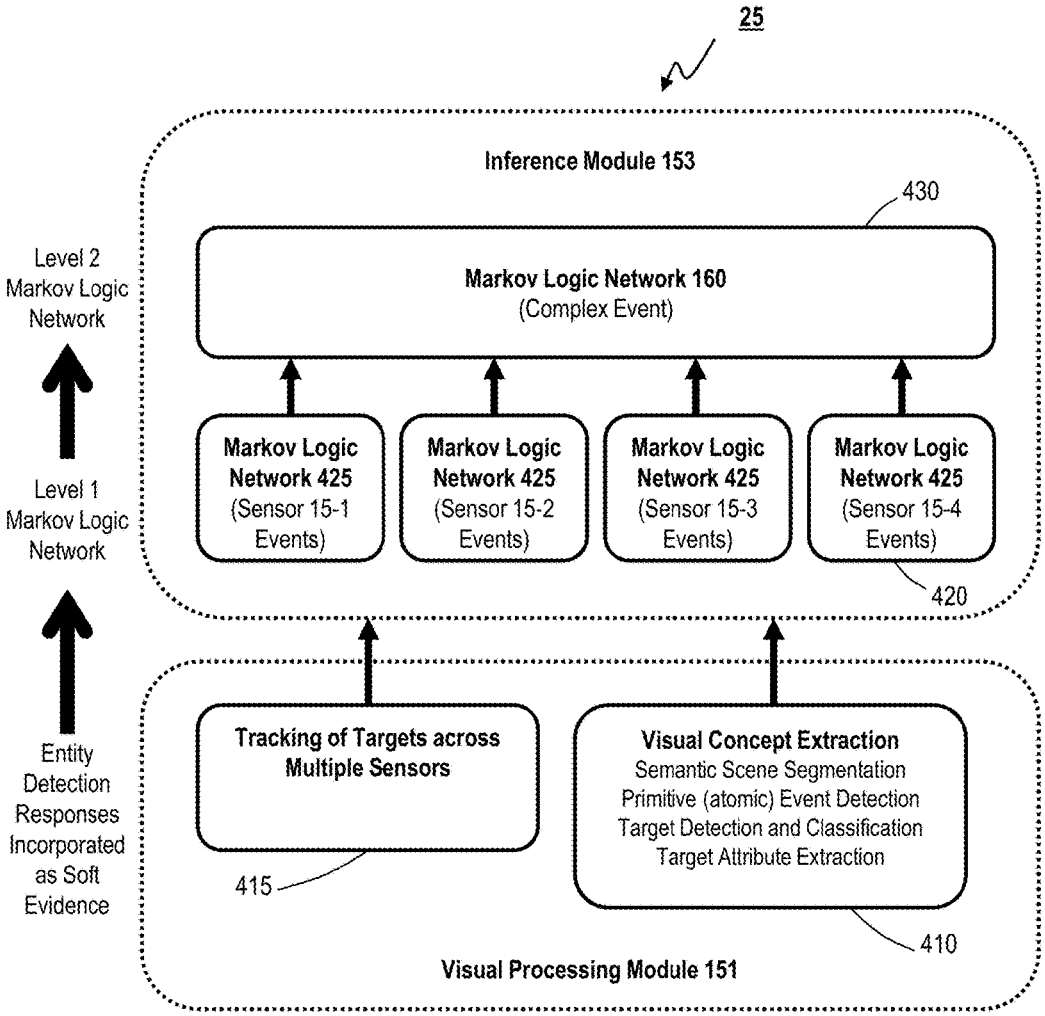
FIG. 4 illustrates a functional block diagram of an surveillance system in accordance with aspects of the present disclosure.

FIG. 4 illustrates a functional flow diagram depicting an example process of the surveillance system 25 in accordance with aspects of the present disclosure. The surveillance system 25 includes visual processing module 151 and inference module 153, which may be the same or similar to those previously discussed herein. In accordance with aspects of the present disclosure, the visual processing module 151 performs scene interpretation to extract visual concepts extraction from an environment (e.g., environment 10) and track targets across multiple sensors (e.g., sensors 15) monitoring the environment.

At 410, the visual processing module 151 extracts the visual concept to determine contextual relations between the elements and targets within a monitored environment (e.g., environment 10), which provide useful information about an activity occurring in the environment. The surveillance system 25 (e.g., using sensors 15) can track a particular target by segmenting images from sensors into multiple zones based, for example, on events indicting the appearance of the target in each zone. In embodiments, the visual processing module 151 categorizes the segmented images into categories. For example, there can be three categories including sky, vertical, and horizontal. In accordance with aspects of the present disclosure, the visual processing module 151 associates objects with semantic labels. Further, the semantic scene labels can then be used to improve target tracking across sensors by enforcing spatial constraints on the targets. An example constraint may be that a human can only appear in image entry region. In accordance with aspects of the present disclosure, the visual processing module 151 automatically infers probability map of the entry or exit regions (e.g., doors 24, 26) of the environment by formulating following rules:

// Image regions where targets appear/disappear are entryExitZones( . . . )

$W_1$: appearI(agent1,z1)→entryExitZone(z1)

$W_1$: disappearI(agent1,z1)→entryExitZone(z1)

// Include adjacent regions also but with lower weights $W_2$: appearI(agent1,z2) Λ zoneAdjacentZone(z1,z2) →entryExitZone(z1)

$W_2$: disappearI(agent1,z2) Λ zoneAdjacentZone(z1,z2) →entryExitZone(z1)

where W2<W1 assign lower probability to the adjacent regions. Predicates appearI(target1, z1), disappearI(target1, z1) and zoneAdjacentZone(z1, z2) are generated from the visual processing module, and represent whether an target appears or disappears in a zone, and whether two zones are adjacent to each other. The adjacency relation between a pair of zones, zoneAdjacentZone(Z1, Z2), is computed based on whether the two segments lie near to each other (distance between the centroids) and if they share boundary. In addition to the spatio-temporal characteristics of the targets, scene elements classification scores are used to write more complex rules for extracting more meaningful information about the scene such as building entry/exit regions. Scene element classification scores can be easily ingested into the Markov logic networks inference system as soft evidences (weighted predicates) zoneClass(z, C). An image zone is a building entry or exit region if it is a vertical structure and only human targets appear or disappear in those image regions. Additional probability may be associated to adjacent regions also:

// Regions with human targets appear or disappear zoneBuildingEntExit(z1)→zoneClass(z1,VERTICAL)

appearI(agent1,z1) Λ class(agent1,HUMAN) →zoneBuildingEntExit (z1)

disappearI(agent1,z1) Λ class(agent1,HUMAN) →zoneBuildingEntExit (z1)

// Include adjacent regions also but with lower weights appearI(agent1,z2) Λ class(agent1,HUMAN) Λ zoneAdjacentZone(z1,z2) Λ zoneClass(z1,VERTICAL) →zoneBuildingEntExit(z1)

disappearI(agent1,z2) Λ class(agent1,HUMAN) Λ zoneAdjacentZone(z1,z2) Λ zoneClass(z1,VERTICAL) →zoneBuildingEntExit(z1)

At 415, the targets detected in multiple sensors by the visual processing module 151 are fused in the Markov logic network 425 using different entity similarity scores and spatial-temporal constraints, with the fusion parameters (weights) learned discriminatively using the Markov logic networks framework from a few labeled exemplars. To fuse the targets, the visual processing module 151 performs entity similarity relation modeling, which associate entities and events observed from data acquired from diverse and disparate sources. Challenges to robust target appearance similarity measure across different sensors include substantial variations resulting from the changes in sensor settings (white balance, focus, and aperture), illumination and viewing conditions, drastic changes in the pose and shape of the targets, and noise due to partial occlusions, cluttered backgrounds, and presence of similar entities in the vicinity of the target. Invariance to some of these changes (such as illumination conditions) can be achieved using distance metric learning that learns a transformation in the feature space such that image features corresponding to the same object are closer to each other.

In embodiments, the inference module 153 performs similarity modeling using Metric Learning. Inference module 153 can employ metric learning approaches based on Relevance Component Analysis (RCA) to enhance similarity relation between same entities when viewed under different imaging conditions. RCA identifies and downscales global unwanted variability within the data belonging to same class of objects. The method transforms the feature space using a linear transformation by assigning large weights to the only relevant dimensions of the features and de-emphasizing those parts of the descriptor which are most influenced by the variability in the sensor data. For a set of N data points $\{(x_{ij};j)\}$ belonging to K semantic classes with data points $n_j$, RCA first centers each data point belonging to a class to a common reference frame by subtracting in-class means $m_j$ (thus removing inter-class variability). It then reduces the intra-class variability by computing a whitening trans-formation of the in-class covariance matrix as:

$$C = \frac{1}{p}\sum_{(j=1)}^{k}\sum_{(i=1)}^{(n_j)}(x_{ji} - m_j)(x_{ji} - m_j)^t \tag{4}$$

wherein the whitening transform of the matrix, $W=C^{(-1/2)}$ is used as the linear transformation of the feature subspace such that features corresponding to same object are closer to each other.

At 420, in accordance with aspects of the present disclosure, the inference module 153 infers associations between the trajectories of the tracked targets across multiple sensors. In embodiments, the inferences are determined using a Markov logic network 425, which performs data association and handles the problem of long-term occlusion across multiple sensors, while maintaining the multiple hypotheses for associations. The soft evidence of association is outputted as, a predicate, e.g., equalTarget( . . . ) with a similarity score recalibrated to a probability value, and used in high-level inference of activities. In accordance with aspects of the present disclosure, the inference module 160 first learns weights for rules of the Markov logic networks 425 rules that govern the fusion of spatial, temporal and appearance similarity scores to determine equality of two entities observed in two different sensors. Using a subset of videos with labeled target associations, Markov logic networks 425 are discriminatively trained.

Tracklets extracted from Kalman filtering are used to perform target associations. Set of tracklets across multiple sensors are represented as $X=x_i$, where a tracklet xi is defined as:

$$x_i = f(c_i, t_i^s, t_i^e, l_i, s_i, o_i, a_i)$$

where $c_i$ is the sensor ID, $t^s_i$ is the start time, $t^e_i$ is the end time, $l_i$ is the location in the image or the map, $o_i$ is the class of the entity (human or vehicle), $s_i$ is the measured Euclidean 3D size of the entity (only used for vehicles), and $a_i$ is appearance model of the target entity. The Markov logic networks rules for fusing multiple cues for the global data association problem are:

$W_1$: temporallyClose($t_i^e$, $t_j^s$)→equalAgent($x_i$,$x_j$)
$W_2$: spatiallyClose($l_i$, $l_j$)→equalAgent($x_i$,$x_j$)
$W_3$: similiarSize($s_i$, $s_j$)→equalAgent($x_i$,$x_j$)
$W_4$: similarClass($o_i$, $o_j$)→equalAgent($x_i$,$x_j$)
$W_5$: similarAppearance($o_i$, $o_j$)→equalAgent($x_i$,$x_j$)
$W_6$: temporallyClose($t_i^e$, $t_j^s$) Λ spatiallyClose($l_i$, $l_j$) Λ similarSize($s_i$, $s_j$) Λ similarClass($o_i$, $o_j$) Λ similarAppearance($o_i$, $o_j$)→equalAgent($x_i$,$x_j$)

where the rules corresponding to individual cues have weights $\{W_i$: i=1; 2; 3; 4; 5$\}$ that are usually lower than $W_6$ which is a much stronger rule and therefore carries larger weight. The rules yield a fusion framework that is somewhat similar to the posterior distribution defined in Equation 4. However, here the weights corresponding to each of the rules can be learned using only a few labeled examples.

In accordance with aspects of the present disclosure, the inference module 153 models temporal difference between the end and start time of a target across a pair of cameras using Gaussian distribution:

$$\text{temporallyClose}(t_i^{A,e}, t_3^{B,s}) = N(f(t_i^{A,e}, t_j^{B,s}); m_t, \sigma_t^2)$$

For the non-overlapping sensors, $f(t^e_i;t^s_j)$ computes this temporal difference. If two cameras are nearby and there is no traffic signal between them, the variance tends to be smaller and contribute a lot to the similarity measurement. However, when two cameras are further away from each other or there are traffic signals in between, this similarity score will contribute less to the overall similarity measure since the distribution would be widely spread due to large variance.

Further, in accordance with aspects of the present disclosure, the inference module 153 determines the spatial distance between objects in the two cameras is measured at the enter/exit regions of the scene. For a road with multiple lanes, each lane can be an enter/exit area. The inference module 153 applies Markov logic network 425 inference to directly classify image segments into enter/exit areas as discussed in section 4. The spatial probability is defined as:

$$\text{spatiallyClose}(l_i^A, l_j^B) = N(\text{dist}(g(l_i^A), g(l_j^B)); m_l, \sigma_l^2)$$

Enter/exit areas of a scene are located mostly near the boundary of the image or at the entrance of a building. Function g is the homography transform to project image locations $l^B$ and $l^A$ to map. Two targets detected in two cameras are only associated if they lie in the corresponding enter/exit areas.

Moreover, in accordance with aspects of the present disclosure, the inference module 153 determines a size similarity score is computed for vehicle targets where we convert a 3D vehicle shape model to the silhouette of the target. The probability is computed as:

$$\text{similarSize}(s_i^A, s_j^B) = N(\|s_i^A - s_j^B\|; m_s, \sigma_s^2)$$

In accordance with aspects of the present disclosure, the inference model 153 also determines a classification similarity:

$$\text{similarClass}(o_j^A, o_j^B)$$

More specifically, the inference model 153 characterizes the empirical probability of classifying a target for each of the visual sensor, as classification accuracy depends on the camera intrinsics and calibration accuracy. Empirical probability is computed from the class confusion matrix for each sensor A where each matrix element RCA i;j represents probability $P(o^A_j|c_i)$ of classifying object j to class i. For computing the classification similarity we assign higher weight to the camera with higher classification accuracy. The joint classification probability of the same object observed from sensor A and B is:

$$P(o_j^A, o_j^B) = \sum_{k=N} P(o_j^A, o_j^B \mid c_k) P(c_k)$$

where $o^A_j$ and $o^A_j$ are the observed classes and $c_k$ is the groundtruth. classification in each sensor is conditionally independent given the object class, the similarity measure can be computed as:

$$P(o_j^A, o_j^B) = \sum_{k=N} P(o_j^A \mid c_k) P(o_j^B \mid c_k) P(c_k)$$

where $P(o^A_j|c_k)$ and $P(o^B_j|c_k)$ can be computed from the confusion matrix, and $P(c_k)$ can be either set to uniform or estimated as the marginal probability from the confusion matrix.

In accordance with aspects of the present disclosure, the inference model 153 further determines an appearance similarity for vehicles and humans. Since vehicles exhibit significant variation in shapes due to viewpoint changes, shape based descriptors did not improve matching scores. Covariance descriptor based on only color, gave sufficiently accurate matching results for vehicles across sensors. Humans exhibit significant variation in appearance compared to vehicles and often have noisier localization due to moving too close to each other, carrying an accessory and forming significantly large shadows on the ground. For matching humans however, unique compositional parts provide strongly discriminative cues for matching. Embodiments disclosed herein compute similarity scores between target images by matching densely sampled patches within a constrained search neighborhood (longer horizontally and shorter vertically). The matching score is boosted by the saliency score S that characterizes how discriminative a patch is based on its similarity to other reference patches. A patch exhibiting larger variance for the K nearest neighbor reference patches is given higher saliency score S(x). In addition to the saliency, in our similarity score we also factor in a relevance based weighting scheme to down weigh patches, that are predominantly due to background clutter. RCA can be used to obtain such a relevance score R(x) from a set of training examples. The similarity $Sim(x^p; x^q)$ measured between the two images, xp and xq, is computed as:

$$\sum_{m,n} \frac{S(x^p_{m,n}) R(x^p_{m,n}) d(x^p_{m,n}, x^q_{m,n})) S(x^q_{m,n}) R(x^q_{m,n})}{\alpha + |S(x^p_{m,n}) - S(x^q_{m,n})|} \tag{5}$$

where $x^p_{m,n}$ denote (m, n) patch from the image, p is the normalization confidence, and the denominator term penalizes large difference in saliency scores of two patches. RCA uses only positive similarity constraints to learn a global metric space such that intra-class variability is minimized. Patches corresponding to highest variability are due to the background clutter and are automatically down weighed during matching. The relevance score for a patch is computed as absolute sum of vector coefficients corresponding to that patch for the first column vector of the transformation matrix. Appearance similarity between targets are used to generate soft evidence predicates similarAppearance $(a^A_i, a^B_j)$ for associating target i in camera A to target j in camera B.

Table 1 below shows event predicates representing various sub-events that are used as inputs for high-level analysis and detecting a complex event across multiple sensors.

| Event Predicate | Description about the Event |
|---|---|
| zoneBuildingEntExit(Z) | Zone is a building entry exit |
| zoneAdjacentZone($Z_1$,$Z_2$) | Two zones adjacent to each other |
| humanEntBuilding( . . . ) | Human enters building |

-continued

| Event Predicate | Description about the Event |
|---|---|
| parkVehicle(A) | Vehicle arriving in the parking lot and stopping in the next time interval |
| driveVehicleAway(A) | Stationary vehicle that starts moving in the next time interval |
| passVehicle(A) | Vehicle observed passing across camera |
| embark(A,B) | Human A comes near vehicle B and disappears after which vehicle B starts moving |
| disembark(A,B) | Human target appears close to a stationary vehicle target |
| embarkWithBag(A,B) | Human A with carryBag( . . . ) predicate embarks a vehicle B |
| equalAgents(A,B) | Agents A and B across different sensors are same(Target association) |
| sensorXEvents( . . . ) | Events observed in sensor X |

In accordance with aspects of the present disclosure, the scene analysis module 155 performs probabilistic fusion for detecting complex events based on predefined rules. Markov logic networks 425 allow principled data fusion from multiple sensors, while taking into account the errors and uncertainties, and achieving potentially more accurate inference over doing the same using individual sensors. The information extracted from different sensors differs in the representation and the encoded semantics, and therefore should be fused at multiple levels of granularity. Low level information fusion would combine primitive events, local entity interactions in a sensor to infer sub-events. Higher level inference for detecting complex events will progressively use more meaningful information as generated from low-level inference to make decisions. Uncertainties may introduces at any stage due to missed or false detection of targets and atomic events, target tracking and association across cameras and target attribute extraction. To this end, the inference model 153 generate predicates with an associated probability (soft evidence). The soft evidence thus enables propagation of uncertainty from the lowest level of visual processing to high-level decision making.

In accordance with aspects of the present disclosure, the visual processing module 151 models and recognizes events in images. The inference module 153 generates groundings at fixed time intervals by detecting and tracking the targets in the images. The generated information includes sensor IDs, target IDs, zones IDs and types (for semantic scene labeling tasks), target class types, location, and time. Spatial location is a constant pair Loc_X_Y either as image pixel coordinates or geographic location (e.g. latitude and longitude) on the ground map obtained using image to map homography. The time is represented as an instant, Time_T or as an interval using starting and ending time, TimeInt_S_E. In embodiments, the visual processing module 151 detects three classes of targets in the scene, vehicles, humans, bags. Image zones are categorized into one of the three geometric classes C classes. The grounded atoms are instantiated predicates and represent either an target attribute or any primitive event it is performing. The ground predicates include: (a) zone classifications zoneClass(Z1, ZType); (b) zone where an target appears appearI(A1, Z1) or disappears disappearI(A1, Z1); (c) target classification class(A1, AType); (d) primitive events appear(A1, Loc; Time), disappear(A1, Loc, Time), move(A1, LocS, LocE, TimeInt) and stationary(A1 Loc, TimeInt); and (e) target is carrying a bag carryBag(A1). The grounded predicates and constants generated from the visual processing module are used to generate Markov Network.

The scene analysis module 155 determines complex events by querying for the corresponding unobserved predicates, running the inference using fast Gibbs sampler and estimating their probabilities. These predicates involve both unknown hidden predicates that are marginalized out during inference and the queried predicates. Example predicates along with their description in the Table 1. The inference module 153 applies Markov logic network 160 inference to detect two different complex activities that are composed of sub-events listed in table 1:

1. bagStealEvent( . . . ): Vehicle appears in sensor C1, a human disembarks the vehicle and enters a building. Vehicle drives away and parks in sensor C2 field of view. After sometime vehicle drives away and is seen passing across sensor C3. It appears in sensor C4 where the human reappears with a bag and embarks the vehicle. The vehicle drives away from sensor.
2. bagDropEvent( . . . ): The sequence of events are similar to bagStealEvent( . . . ) with the difference that human enters the building with a bag in sensor C1 and reappears in sensor C2 without a bag.

Complex activities are spread across network of four sensors and involve interactions between multiple targets, a bag and the environment. For each of the activities, the scene analysis module 155 identifies a set of sub-events that are detected in each sensor (denoted by sensorXEvents( . . . )). The rules of Markov logic network 160 for detecting sub-events for the complex event bagStealEvent( . . . ) in sensor C1 can be:

$$\text{disembark}\,A_1,A_2,\text{Int}_1,T_1)\ \Lambda\ \text{humanEntBuilding}(A_3,T_2)\ \Lambda\ \text{equal Agents}(A_1,A_3)\ \Lambda\ \text{driveVehicleAway}(A_2,\text{Int}_2)\ \Lambda\ \text{sensorType}(C_1)\rightarrow\text{sensor1Events}(A_1,A_2,\text{Int}_2)$$

The predicate sensorType( . . . ) enforces hard constraints that only confidences generated from sensor C1 are used for inference of the query predicate. Each of the sub-events are detected using Markov logic networks inference engine associated to each sensor and the result predicates are fed into higher level Markov logic networks along with the associated probabilities, for inferring complex event. The rule formulation of the bagStealEvent( . . . ) activity are can be follows:

$$\text{sensor1Events}(A_1,A_2,\text{Int}_1)\ \Lambda\ \text{sensor2Events}(A_3,A_4,\text{Int}_2)\ \Lambda$$
$$\text{afterInt}(\text{Int}_1,\text{Int}_2)\ \Lambda\ \text{equalAgents}(A_1,A_3)\ \Lambda\ \ldots\ \Lambda\ \text{sensorNEvents}(A_M,A_N,\text{Int}_K)\ \Lambda\ \text{afterInt}(\text{Int}_K-1,\text{Int}_K)\ \Lambda\ \text{equalAgents}(A_M-1,A_M)\rightarrow\text{ComplexEvent}(A_1,\ \ldots,\ A_M,\text{Int}_K)$$

First order predicate logic (FOPL) rule for detecting generic complex event involving multiple targets and target association across multiple sensors. For each sensor, a predicate is defined for events occurring in that sensor. The targets in that sensor are associated to the other sensor using target association Markov logic networks 425 (that infers equalTarget( . . . ) predicate). The predicate after Int(Int1, Int2) is true if the time interval Int1 occurs before the Int2.

Inference in Markov logic networks is a hard problem, with no simple polynomial time algorithm for exactly counting the number of true cliques (representing instantiated formulas) in the network of grounded predicates. The nodes in the Markov logic networks grows exponentially with the number of rules (e.g., instances and formulas) in the Knowledge Base. Since all the confidences are used to instantiate all the variables of the same type, in all the predicates used in the rules, predicates with high arity cause combinatorial explosion in the number of possible cliques formed after the grounding step. Similarly long rules also cause high order dependencies in the relations and larger cliques in Markov logic networks.

A Markov logic network, providing bottom-up grounding by employing Relation Database Management System (RDBMS) as a backend tool for storage and query. The rules in the Markov logic networks are written to minimize combinatorial explosion during inference. Conditions, as the last component of either the antecedent or the consequent, to restrict the range of confidences can be used for grounding a formula. Using hard constraints further also improves tractability of inference as an interpretation of the world violating a hard constraint has zero probability and can be readily eliminated during bottom-up grounding. Using multiple smaller rules instead of one long rule also improves the grounding by forming smaller cliques in the network and fewer nodes. Embodiments disclosed herein further reduce the arity of the predicates by combining multiple dimensions of the spatial location (X-Y coordinates) and time interval (start and end time) into one unit. This greatly improves the grounding and inference step. For example, the arity of the predicate move(A, LocX1, LocY 1, Time1, LocX2, LocY 2, Time2) gets reduced to move(A, LocX1 Y 1, LocX2 Y 2; IntTime1 Time2). Scalable Hierarchical Inference in Markov logic networks: Inference in Markov logic networks for sensor activities can be significantly improved if, instead of generating a single Markov logic network for all the activities, embodiments explicitly partition the Markov logic network into multiple activity specific networks containing only the predicate nodes that appear in only the formulas of the activity. This restriction effectively considers only a Markov Blanket (MB) of a predicate node for computing expected number of true groundings and had been widely used as an alternative to exact computation. From implementation perspective this is equivalent to having a separate Markov logic networks inference engine for each activities, and employing a hierarchical inference where the semantic information extracted at each level of abstraction is propagated from the lowest visual processing level to sub-event detection Markov logic networks engine, and finally to the high-level complex event processing module. Moreover, since the primitive events and various sub-events (as listed in Table 1) are dependent only on temporally local interactions between the targets, for analyzing long videos we divide a long temporal sequence into multiple overlapping smaller sequences, and run Markov logic networks engine within each of these sequences independently. Finally, the query result predicates from each temporal windows are merged using a high level Markov logic networks engine for inferring long-term events extending across multiple such windows. A significant advantage is that it supports soft evidences that allows propagating uncertainties in the spatial and temporal fusion process used in our framework. Result predicates from low-level Markov logic networks are incorporated as rules with the weights computed as log odds of the predicate probability $\ln(p/(1-p))$. This allows partitioning the grounding and inference in the Markov logic networks in order to scale it to larger problems.

Figure 5:
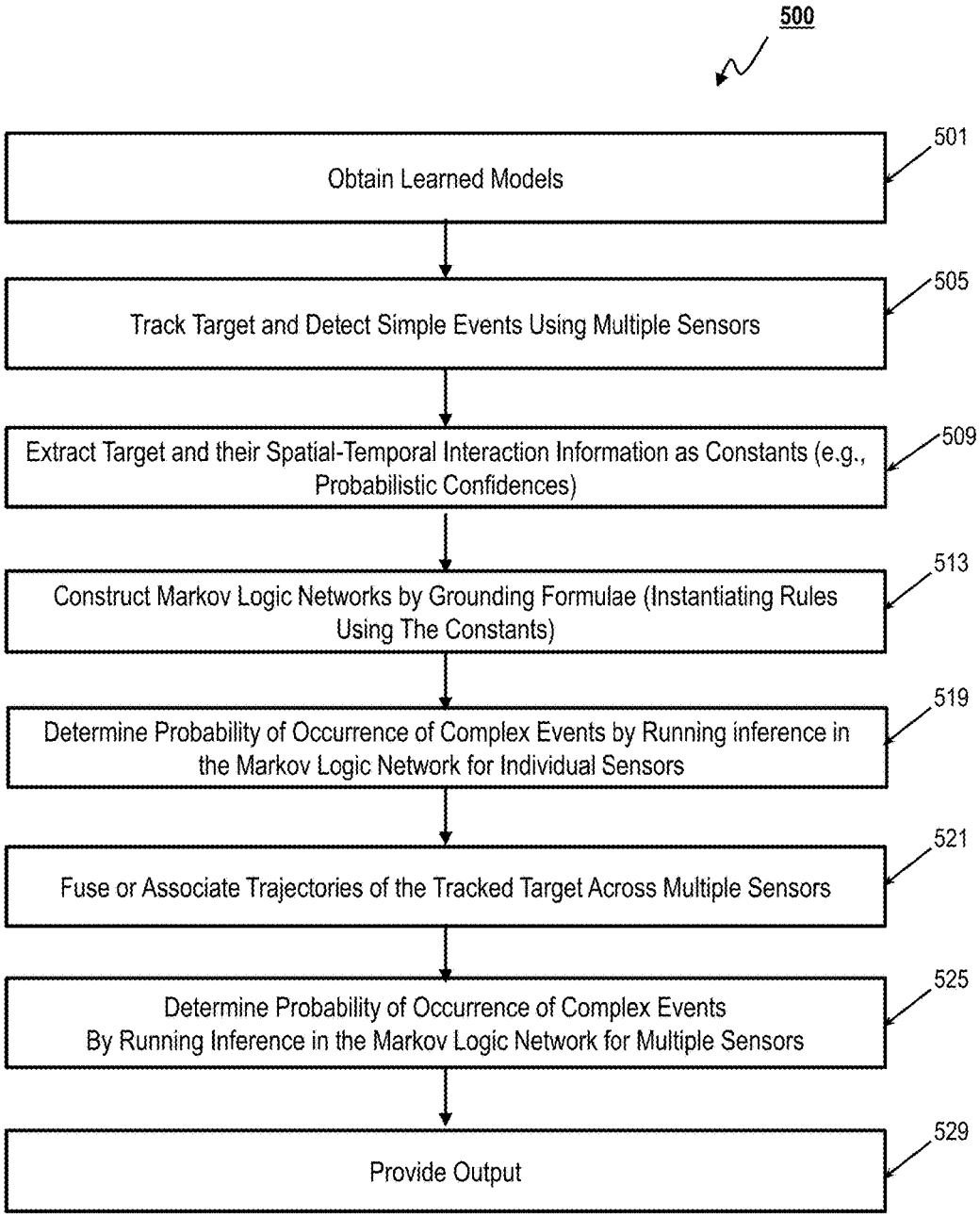
FIG. 5 illustrates a flow diagram of a process in accordance with aspects of the present disclosure.

The flow diagram in FIG. 5 illustrates functionality and operation of possible implementations of systems, devices, methods, and computer program products according to various embodiments of the present disclosure. Each block in the flow diagram of FIG. 5 can represent a module, segment, or portion of program instructions, which includes one or more computer executable instructions for implementing the illustrated functions and operations. In some alternative implementations, the functions and/or operations illustrated in a particular block of the flow diagrams can occur out of the order shown in FIG. 5. For example, two blocks shown in succession can be executed substantially concurrently, or the blocks can sometimes be executed in the reverse order, depending upon the functionality involved. It will also be noted that each block of the flow diagrams and combinations of blocks in the block can be implemented by special purpose hardware-based systems that perform the specified functions or acts, or combinations of special purpose hardware and computer instructions.

FIG. 5 illustrates a flow diagram of an process 500 in accordance with aspects of the present disclosure. At 501, the process 500 obtains learned models (e.g., learned models 136). As described previously herein, the learned models can include proximity relationships, similarity relationships, object representations, scene elements, libraries of actions that targets can perform. For example, an environment (e.g., environment 10) can include a building (e.g., building 20) having a number of entrances (e.g., doors 22, 24) that is visually monitored by a surveillance system (e.g., surveillance system 25) using a number of sensors (e.g., sensors 15) having at least one non-overlapping field of view. The learned models can, for example, identify a ground plane in the field of view of each of the sensors. Additionally, the learned module can identify objects such as entrance points of the building in the field of view of each of the cameras.

At 505, the process 500 tracks one or more targets (e.g., target 30 and/or 35) detected in the environment using multiple sensors (e.g., sensors 15). For example, the surveillance system can control the sensors to periodically or continually obtain images of the tracked target as it moves through the different fields of view of the sensors. Further, the surveillance system can identify a human target holding a package (e.g., target 30 with package 31) the moves in and out of the field of view of one or more of cameras. The identification and tracking of the targets can be performed as described previously herein At 509, the process 500 (e.g., using visual processing module 151) extracts target information and spatial-temporal interaction information of the targets tracked at 505 as probabilistic confidences, as previously described herein. In embodiments, extracting information includes determining the position of the targets, classifying the targets, and extracting attributes of the targets. For example, the process 500 can determine spatial and temporal information of a target in the environment, classify the target a person (e.g., target 30, and determine an attribute of the person is holding a package (e.g., package 31). As previously described herein, the process 500 can reference information in learned models 136 for classifying the target and identifying its attributes.

At 513, the process 500 constructs a Markov logic networks (e.g., Markov logic networks 160 and 425) by grounded formulae based on each of the confidences determined at 509 by instantiating rules from a knowledge base (e.g., knowledge base 138), as previously described herein. At 519, the process 500 (e.g., using scene analysis module 135) determines probability of occurrence of a complex event based on the Markov logic network constructed at 513 for individual sensor, as previously described herein. For example, an event of a person leaving the package in the building can be determined based on a combination of events, including the person entering the building with a package and the person exiting the building without the package.

At 521, the process (e.g., using the inference module 153) fuses the trajectory of the target across more than one of the sensors. As previously discussed herein, a single target may be tracked individually by multiple cameras. In accordance with aspects of the invention, the tracking information is analyzed to identify the same target in each of the cameras to fuse their respective information. For example, the process may use an RCA analysis. In some embodiments, where the target disappears and reappears at one or more entrances of the building, the process may use a Markov logic networks (e.g., Markov logic network 425) to predict how the duration of time during which the target disappears and reappears.

At 525, the process 500 (e.g., using scene analysis module 135) determines probability of occurrence of a complex event based on the Markov logic network constructed at 513 for multiple sensors, as previously described herein. At 529, the process 500 provides an output corresponding to one or more of the complex events inferred at 525. For example, based on a predetermined sets of complex events inferred from the Markov logic network, the process (e.g., using scene analysis module) may retrieve images identified with to the complex event and provide them While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A surveillance system comprising a computing device comprising a processor and computer-readable storage device storing program instructions that, when executed by the processor, cause the computing device to perform operations comprising:

tracking a target in an environment using sensors;

extracting information from images of the target provided by the sensors;

determining a plurality of confidences corresponding to the information extracted from images of the target; the plurality of confidences including at least one confidence corresponding to at least one primitive event;

determining grounded formulae by instantiating predefined rules using the plurality of confidences;

inferring a complex event corresponding to the target using the grounded formulae; and providing an output describing complex event, wherein:

the predefined rules comprise hard rules and soft rules, the hard rules comprise a first plurality of rules adapted to set a probability of the complex event to zero when violated, the soft rules comprise a second plurality of rules adapted to make the complex event less probable, but not impossible, when violated, and the soft rules are associated with weights representing uncertainty.

2. The system of claim 1, wherein extracting the information comprises:

segmenting scenes captured by the sensors;

detecting the at least one primitive event;

classifying the target; and extracting attributes of the target.

3. The system of claim 2, wherein the at least one primitive event includes disappearing from a scene and reappearing in the scene.

4. The system of claim 1, wherein the operations further comprise constructing a Markov logic network from the grounded formulae.

5. The system of claim 1, wherein the operations further comprise controlling the computing device to fuse the trajectory of the target across more than one of the sensors using a Markov logic network.

6. The system of claim 1, wherein:

at least one of the sensors is an non-calibrated sensor; and the sensors have at least one non-overlapping field of view.

7. A method for a surveillance system comprising:

tracking a target n an environment using sensors;

extracting information from images of the target provided by the sensors;

determining a plurality of confidences corresponding to the information extracted from images of the target, the plurality of confidences including at least one confidence corresponding to at least one primitive event;

determining grounded formulae by instantiating predefined rules using plurality of confidences;

inferring a complex event corresponding to the target using the grounded formulae; and providing an output describing the complex event wherein:

the predefined rules comprise hard rules and soft rules, the hard rules comprise a first plurality of rules adapted to set a probability of the complex event to zero when violated, the soft rules comprise a second plurality of rules adapted to make the complex event less probable, but not impossible, when violated, and the soft rules are associated with weights representing uncertainty.

8. The method of claim 7, wherein extracting the information comprises:

segmenting scenes captured by the sensors;

detecting the at least one primitive event;

classifying the target; and extracting attributes of the target.

9. The method of claim 8, wherein the at least one primitive event includes disappearing from a scene and reappearing in the scene.

10. The method of claim 7, further comprising constructing a Markov logic network from the grounded formulae.

11. The method of claim 7, further comprising fusing the trajectory of the target across more than one of the sensors.

12. The method of claim 11, further comprising performing the fusing using a Markov logic network.

13. A non-transitory computer-readable medium storing computer-executable program instructions that, when executed by a computer, cause the computer to perform operations comprising:

tracking a target in an environment using sensors;

extracting information from images of the target provided by the sensors;

determining a plurality of confidences corresponding to the information extracted from images of the target; the plurality of confidences including at least one confidence corresponding to at least one primitive event;

determining grounded formulae by instantiating predefined rules using the plurality of confidences;

inferring a complex event corresponding to the target using the grounded formulae; and providing an output describing the complex event wherein:

the predefined rules comprise hard rules and soft rules, the hard rules comprise a first plurality of rules adapted to set a probability of the complex event to zero when violated, the soft rules comprise a second plurality of rules adapted to make the complex event less probable, but not impossible, when violated, and the soft rules are associated with weights representing uncertainty.

14. The non-transitory computer-readable medium of claim 13, wherein extracting the information comprises:

segmenting scenes captured by the sensors;

detecting the at least one primitive event;

classifying the target; and extracting attributes of the target.

15. The non-transitory computer-readable medium of claim 14, wherein the at least one primitive event includes disappearing from a scene and reappearing in the scene.

16. The non-transitory computer-readable medium of claim 13, wherein the operations further comprise controlling the computing device to construct a Markov logic network from the grounded formulae.

17. The non-transitory computer-readable medium of claim 13, wherein the operations further comprise controlling the computing device to fuse the trajectory of the target across more than one of the sensors.

18. The system of claim 1, wherein inferring a complex event comprises determining that a complex event likely occurred based only on other observed events and not based on a direct observation of the complex event itself.

19. The system of claim 1, wherein the hard rules and the soft rules model spatial and temporal interactions between various entities and a temporal structure of a plurality of complex events.

20. A surveillance system comprising a computing device comprising a processor and computer-readable storage device storing program instructions that, when executed by the processor, cause the computing device to perform operations comprising:

tracking a target in an environment using sensors;

extracting information from images of the target provided by the sensors;

determining a plurality of confidences corresponding to the information extracted from images of the target, the plurality of confidences including at least one confidence corresponding to at least one primitive event;

determining grounded formulae by instantiating predefined rules using the plurality of confidences;

inferring a complex event corresponding to the target using the grounded formulae; and providing an output describing the complex event, wherein:

the predefined rules comprise hard rules and soft rules, the hard rules comprise a first plurality of rules adapted to set a probability of the complex event to zero when violated, the soft rules comprise a second plurality of rules adapted to make the complex event less probable, but not impossible, when violated, the hard rules and soft rules comprise first order predicate logic formulas of a Markov logic network, and the soft rules are associated with weights representing uncertainty.

21. The system of claim 1, wherein the predefined rules define observable events in the environment evincing an occurrence of the complex event.

22. The system of claim 21, wherein inferring the complex event comprises determining that the complex event occurred based only on the observable events and not based on a direct observation of the complex event.

23. The system of claim 22, wherein, the complex event comprises an occurrence determined to have occurred based only on circumstantial evidence.

24. The system of claim 23, wherein the observable events comprise occurrences involving the target in relation to a predefined object in the environment.

25. The system of claim 1, wherein:

the complex event is one of a plurality of complex events predefined for a particular environment;

each of the plurality of complex events comprises a plurality of observable events relevant to a predetermined threat for which a surveillance system monitors in the environment.

26. The system of claim 1, wherein the at least one primitive event comprises time information and location information obtained from a track of the target.

27. The system of claim 1, wherein the predefined rules comprise first order predicate logic formulas of a Markov logic network.

28. The method of claim 7, wherein the predefined rules comprise first order predicate logic formulas of a Markov logic network.

29. The non-transitory computer-readable medium of claim 13, wherein the predefined rules comprise first order predicate logic formulas of a Markov logic network.

30. A surveillance system comprising a computing device comprising a processor and computer-readable storage device storing program instructions that, when executed by the processor, cause the computing device to perform operations comprising:

observing events in relation to a target moving in an environment using one or more cameras;

determining, based on the observed events, information describing the target in the environment, the information including attributes of the target and spatial-temporal interactions of the target in the environment;

determining a plurality of confidences corresponding to the information describing the target, the plurality of confidences including at least one confidence corresponding to at least one primitive event;

determining grounded formulae by instantiating a plurality of rules corresponding to the observed events using the plurality of confidences;

inferring an occurrence of a complex event in the environment corresponding to the target using the grounded formulae; and providing an output describing the complex event, wherein:

the predefined rules comprise hard rules and soft rules, the hard rules comprise a first plurality of rules adapted to set a probability of the complex event to zero when violated, the soft rules comprise a second plurality of rules adapted to make the complex event less probable, but not impossible, when violated, and the soft rules are associated with weights representing uncertainty.

* * * * *